US007896696B2

(12) United States Patent
Hamai et al.

(10) Patent No.: US 7,896,696 B2
(45) Date of Patent: Mar. 1, 2011

(54) DIVIDED CONNECTOR FOR REGULATING A TERMINAL

(75) Inventors: Tsuyoshi Hamai, Makinohara (JP); Eisuke Suzuki, Makinohara (JP); Tomihiko Nagayoshi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/629,443

(22) Filed: Dec. 2, 2009

(65) Prior Publication Data

US 2010/0136829 A1 Jun. 3, 2010

(30) Foreign Application Priority Data

Dec. 3, 2008 (JP) ..... P2008-308732

(51) Int. Cl.
*H01R 13/40* (2006.01)

(52) U.S. Cl. ..... 439/595

(58) Field of Classification Search ..... 439/595, 439/598, 752.5, 752, 751
See application file for complete search history.

(56) References Cited

U.S. PATENT DOCUMENTS 3,982,805 A * 9/1976 Irie ..... 439/595
6,048,226 A 4/2000 Iwahori

FOREIGN PATENT DOCUMENTS

JP 11-86948 3/1999

* cited by examiner

*Primary Examiner*—Javaid Nasri
(74) *Attorney, Agent, or Firm*—Morgan, Lewis & Bockius LLP

(57) ABSTRACT

A divided connector, comprises a terminal having an electric contact part protruding from a main body front part and an electric wire attached under pressure to a main body rear part; an inner housing that allows the terminal inserted into an inner part to be engaged with a terminal engaging piece and attached and the main body front part to protrude from a front end; an outer housing that allows the inner housing inserted into an inner part from a rear part to be engaged with a flexible engaging piece and attached; a terminal positioning regulating wall provided in the outer housing and having a contact part inserting hole for inserting the electric contact part; and a front part positioning frame protruding in the rear surface of the terminal positioning regulating wall correspondingly to the contact part inserting hole to enclose and position the main body front part.

5 Claims, 11 Drawing Sheets

DIVIDED CONNECTOR FOR REGULATING A TERMINAL

BACKGROUND OF THE INVENTION

1. Field of the Invention

The present invention relates to a divided connector in which housing component members are divided into a plurality of parts.

2. Description of the Related Art

As a connector used in a wiring of a vehicle or the like, there is a divided connector in which housing component members are divided into a plurality of parts to position a terminal (for instance, see Patent document 1). This connector 500 includes, as shown in FIG. 12, an inner housing 503 to which a terminal 501 is attached, an outer housing 505 to which the inner housing 503 is attached from a rear part and a front holder 507 attached to a front part of the outer housing 505.

As shown in FIG. 13(*a*), when the inner housing 503 to which the terminal 501 is attached is inserted into the outer housing 505 from the rear part of the outer housing 505, a flexible engaging piece 511 of the outer housing 505 is engaged with a protrusion 509 to regulate the separation of the inner housing 503. When the inner housing 503 is attached to the outer housing, and then, the front holder 507 is inserted into the outer housing from the front part of the outer housing 505 in a main engaging operation, as shown in FIG. 13(*b*), a fitting hole 513 formed in the front holder 507 is fitted to a front part of a main body part 515 of the terminal 501 so that an end of the terminal 501 may be positioned.

Patent Document 1: JP-A-11-86948

However, since the housing component members of the usual divided connector 500 include three members of the inner housing 503, the outer housing 505 and the front holder 507, when production tolerances of the members are respectively accumulated, a backlash is disadvantageously liable to occur between the components parts. That is, when there is a backlash of $\delta 1$ between the inner housing 503 and the outer housing 505, and there is a backlash of $\delta 2$ between the outer housing 505 and the front holder 507, the backlash of $(\delta 1+\delta 2)$ may be possibly accumulated in the terminal 501 and the front holder 507 at the maximum. In a positioning structure of the terminal in which the above-described cumulative backlash arises, when a tension is applied to the terminal 501 through an electric wire, there is a fear that the terminal 501 may be deformed or unevenness may occur in the position of an electric contact part 517 of the end of the terminal as shown by a broken line in FIG. 13(*b*). Further, since the terminal 501 is held by a plurality of divided members, a sufficient holding strength is inconveniently hardly ensured.

The present invention is proposed by considering the above-described circumstances and it is an object of the present invention to provide a divided connector which can regulate the position of a terminal by the small number of parts, so that a positioning accuracy and a holding strength may be improved by eliminating a backlash.

SUMMARY OF THE INVENTION

The above-described object of the present invention is achieved by below-described structures.

A first aspect of the invention provides with a divided connector, comprising a terminal having an electric contact part protruding from a main body front part and an electric wire attached under pressure to a main body rear part; an inner housing that allows the terminal inserted into an inner part to be engaged with a terminal engaging piece and attached and the main body front part to protrude from a front end; an outer housing that allows the inner housing inserted into an inner part from a rear part to be engaged with a flexible engaging piece and attached; a terminal positioning regulating wall provided in the outer housing and having a contact part inserting hole for inserting the electric contact part; and a front part positioning frame protruding in the rear surface of the terminal positioning regulating wall correspondingly to the contact part inserting hole to enclose and position the main body front part.

According to the divided connector of the present invention, when the inner housing to which the terminal is attached is inserted into the outer housing, the main body front part of the terminal protruding from the front end of the inner housing is positioned by the front part positioning frame provided in the outer housing. Thus, the front holder that is usually employed is not required so that the position of the terminal may be regulated with a high strength and no backlash by using the small number of parts.

A second aspect of the invention provides with the divided connector, wherein the front part positioning frame includes an engaging piece regulating bottom plate that is inserted into the disengaging space of the terminal engaging piece to regulate the displacement of the terminal engaging piece toward a disengaging direction.

According to the divided connector of the present invention, when the inner housing is attached to the outer housing, the engaging piece regulating bottom plate provided in the outer housing enters the disengaging space of the terminal engaging piece of the inner housing to regulate the displacement of the terminal engaging piece toward the disengaging direction. Thus, the double engagement of the terminal is realized.

A third aspect of the invention provides with the divided connector, wherein a pair of separated engaging piece regulating bottom plates are inserted into both sides in a lower surface of the terminal engaging piece.

According to the divided connector of the present invention, the one pair of engaging piece regulating bottom plates abut on both the sides of the terminal engaging piece so that the terminal engaging piece may be regulated in a horizontal direction where the displacement is small in a distorting direction. Thus, the reliability of the double engagement is enhanced. Further, since a part of the terminal engaging piece can be inserted into the spaced part, the thickness of that part can be increased so that the terminal engaging piece of high strength may be formed.

A fourth aspect of the invention provides with the divided connector, wherein the terminal engaging piece has an inclined surface whose thickness is gradually reduced toward an inserting direction of the inner housing and comes into contact with the engaging piece regulating bottom plate through the inclined surface.

According to the divided connector of the present invention, when the inner housing is inserted into the outer housing, the inclined surface of the terminal engaging piece is gradually mounted on the engaging piece regulating bottom plate and the terminal engaging piece is bent toward a direction in which the terminal engaging piece is separated from the engaging piece regulating bottom plate, that is, a direction in which the terminal engaging piece is more strongly engaged with the terminal. Thus, the terminal can be more strongly fixed due to the pressure of the terminal engaging piece.

Since the divided connector of the present invention includes the inner housing that allows the main body front part of the terminal to protrude and the terminal to be attached, the outer housing that allows the inner housing to be attached and the front part positioning frame protruding in the terminal positioning regulating wall of the outer housing to enclose and position the main body front part of the terminal, the front holder that has been hitherto used is removed and the position of the terminal can be regulated by the small number of parts by using the front part positioning frame directly provided in the outer housing. As a result, the backlash can be eliminated and the positioning accuracy and the holding strength of the terminal can be improved.

DESCRIPTION OF THE PREFERRED EMBODIMENTS

Figure 1:
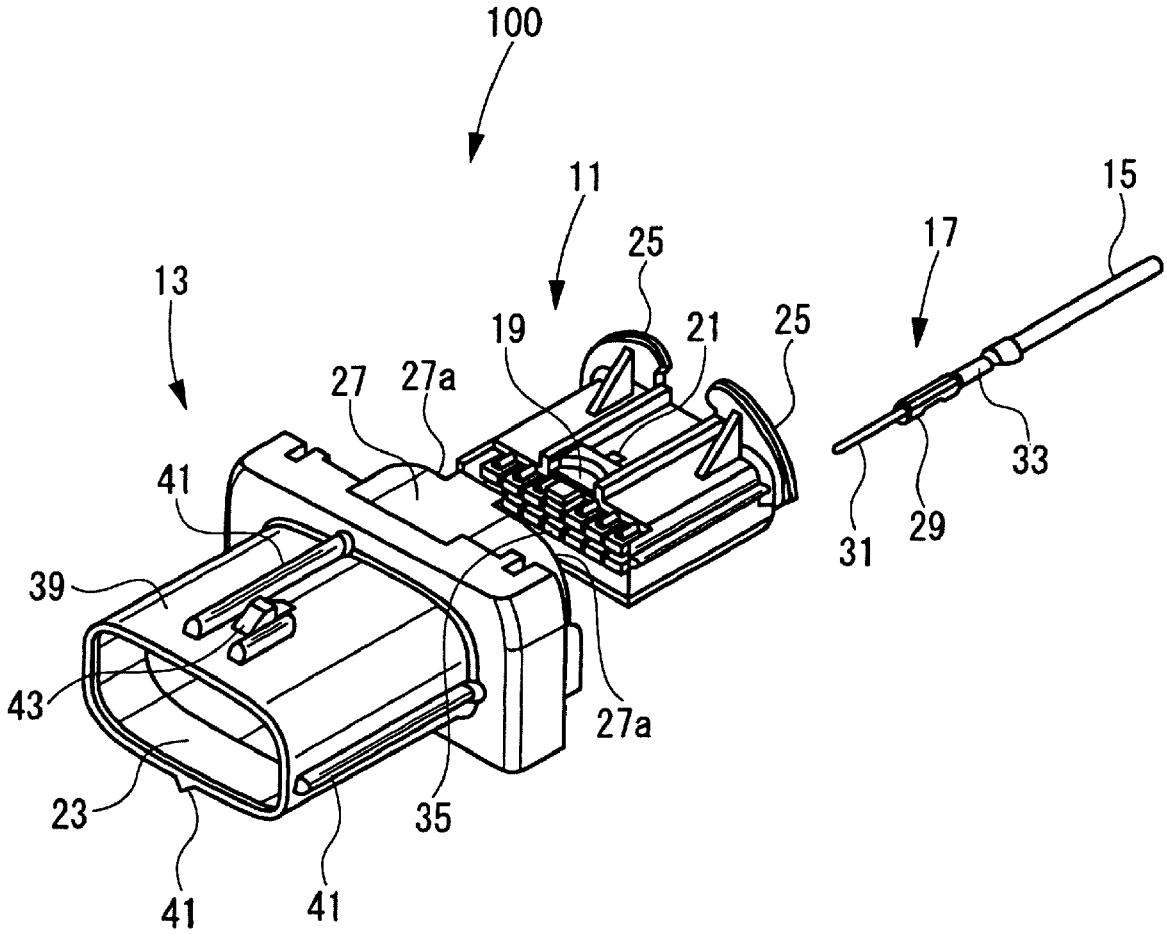
FIG. 1 is an exploded perspective view of a divided connector according to the present invention.

Now, a preferred exemplary embodiment of a divided connector according to the present invention will be described below by referring to the drawings.

FIG. 1 is an exploded perspective view of the divided connector according to the present invention.

Figure 12:
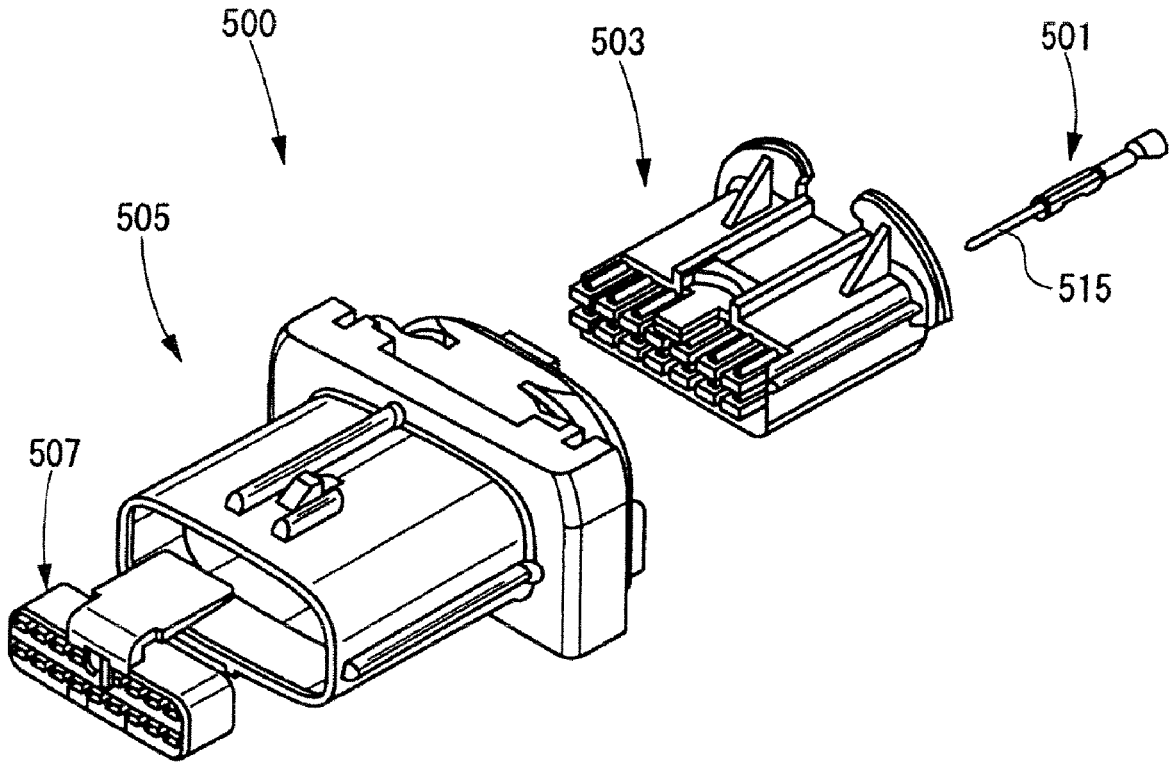
FIG. 12 is an exploded perspective view of a usual divided connector.
Figure 13:
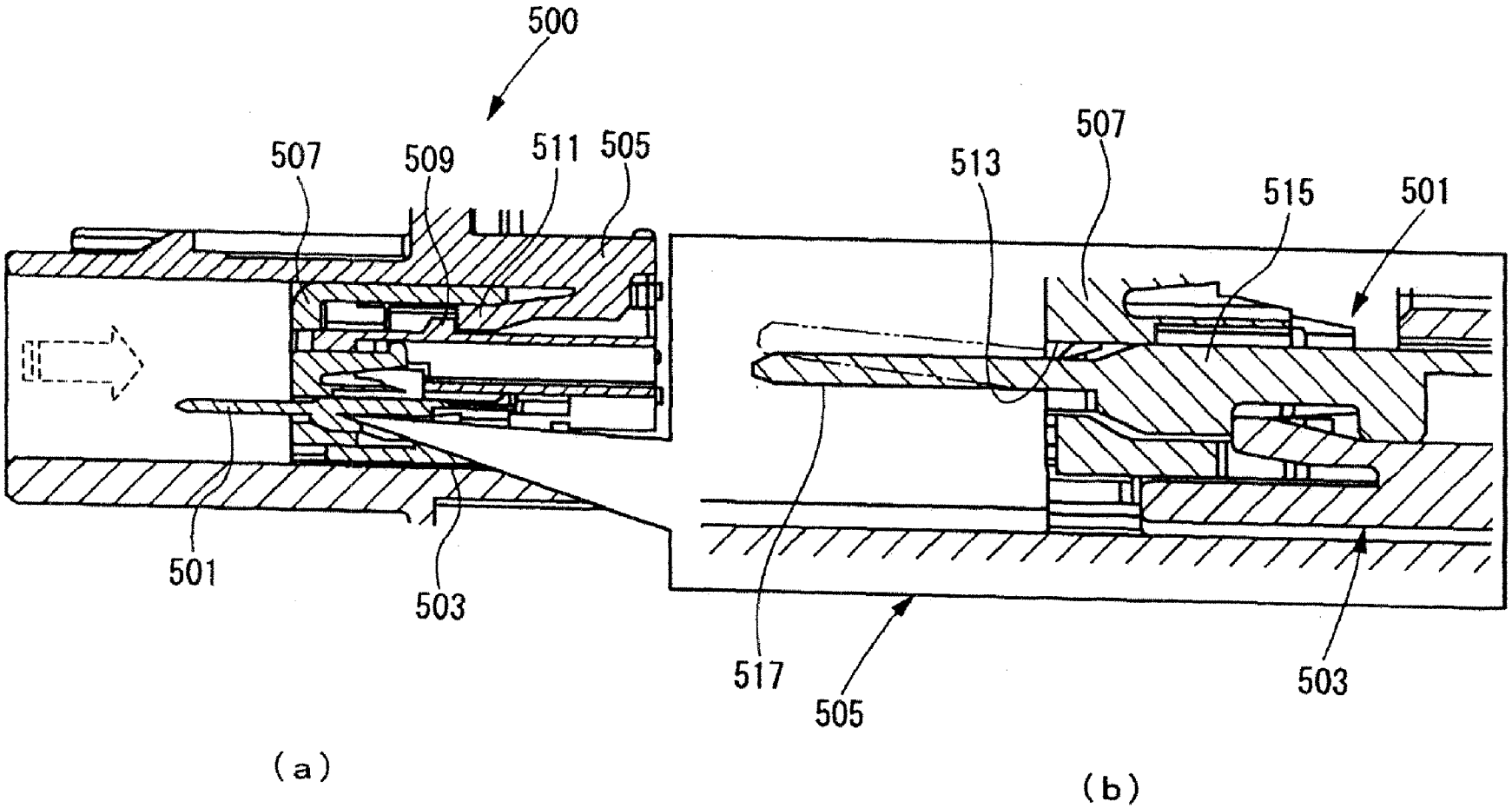
FIG. 13(*a*) is a sectional view of a front holder attaching part of the divided connector shown in FIG. 12 and FIG. 13(*b*) is an enlarged view of a main part thereof.

In the divided connector 100 according to the present exemplary embodiment, a housing is divided into two parts including an inner housing 11 and an outer housing 13. Namely, the front holder 507 (see FIG. 12) that has been hitherto used is removed. To the inner housing 11, a terminal 17 to which an electric wire 15 is attached under pressure is attached. The inner housing 11 to which the terminal 17 is attached is attached to the outer housing 13.

On the upper surface of the inner housing 11, are provided a temporary engaging hole 19 and a main engaging hole 21 that is provided in the rear part of the temporary engaging hole 19. In this specification, a connection opening part 23 side to a mate connector of the divided connector 100 is explained as a front part and an opposite side is explained as a rear part. In the rear part of the inner housing 11, one pair of collar parts 25 and 25 that protrude upward is provided. The collar parts 25 and 25 abut on stepped parts 27*a* and 27*a* of a rear end face of a mounting part 27 of the outer housing 13.

The terminal 17 has an electric contact part 31 protruding from a main body front part 29 and a main body rear part 33 to which the electric wire 15 is attached under pressure. In the present exemplary embodiment, a case is described that the divided connector 100 is a male connector to which the male terminal 17 having the small strip (what is called a tab) shaped electric contact part 31 is attached as an example, however, the present invention may be applied to a female connector to which a female terminal is attached. When the terminal 17 is attached to the inner part of the inner housing 11, the electric contact part 31 and the main body front part 29 are exposed from an opening 35 of a terminal accommodating chamber in a front end.

The outer housing 13 has the above-described mounting part 27 protruding in a main body rear part and a hood part 39 protruding in a main body front part. The hood part 39 has the above-described connection opening part 23 to the mate connector opened in a front surface. A plurality of guide protrusions 41 or a locking protrusion 43 to the mate connector protrudes in the outer periphery of the hood part 39.

Figure 2:
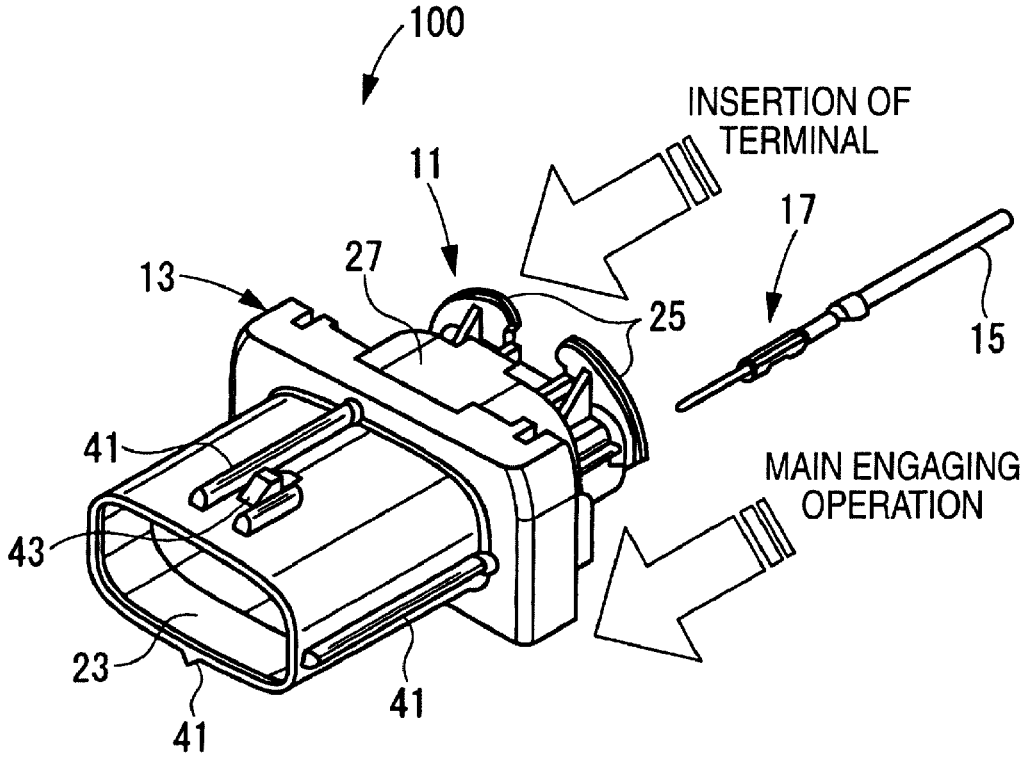
FIG. 2(*a*) is an exploded perspective view of the divided connector shown in FIG. 1 in a temporarily engaged state, and FIG. 2(*b*) is a perspective view of the divided connector in a normally engaged state.
Figure 2:
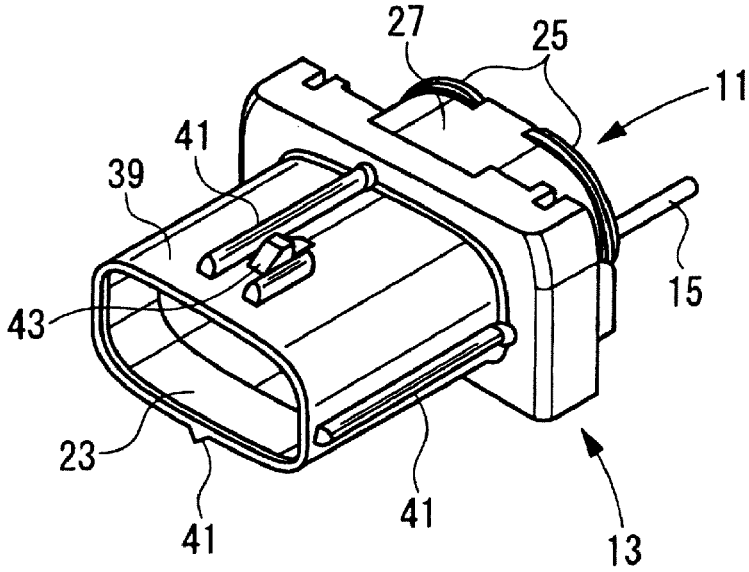

FIG. 2(*a*) is an exploded perspective view showing a state that the divided connector shown in FIG. 1 is temporarily engaged. FIG. 2(*b*) is a perspective view showing a normally engaged state of the divided connector.

In the divided connector 100, as shown in FIG. 2(*a*), the terminal 17 to which the electric wire 15 is attached under pressure is attached to the inner housing 11 temporarily engaged with the outer housing 13. Then, the inner housing 11 to which the terminal 17 is attached is pushed into a position where the collar part 25 and 25 abut on the mounting part 27 as shown in FIG. 2(*b*). Thus, the inner housing 11 is normally engaged with the outer housing 13. As described below, by this normal engagement, the main body front part 29 of the terminal 17 is positioned and the double engagement of the terminal 17 is realized.

Figure 3:
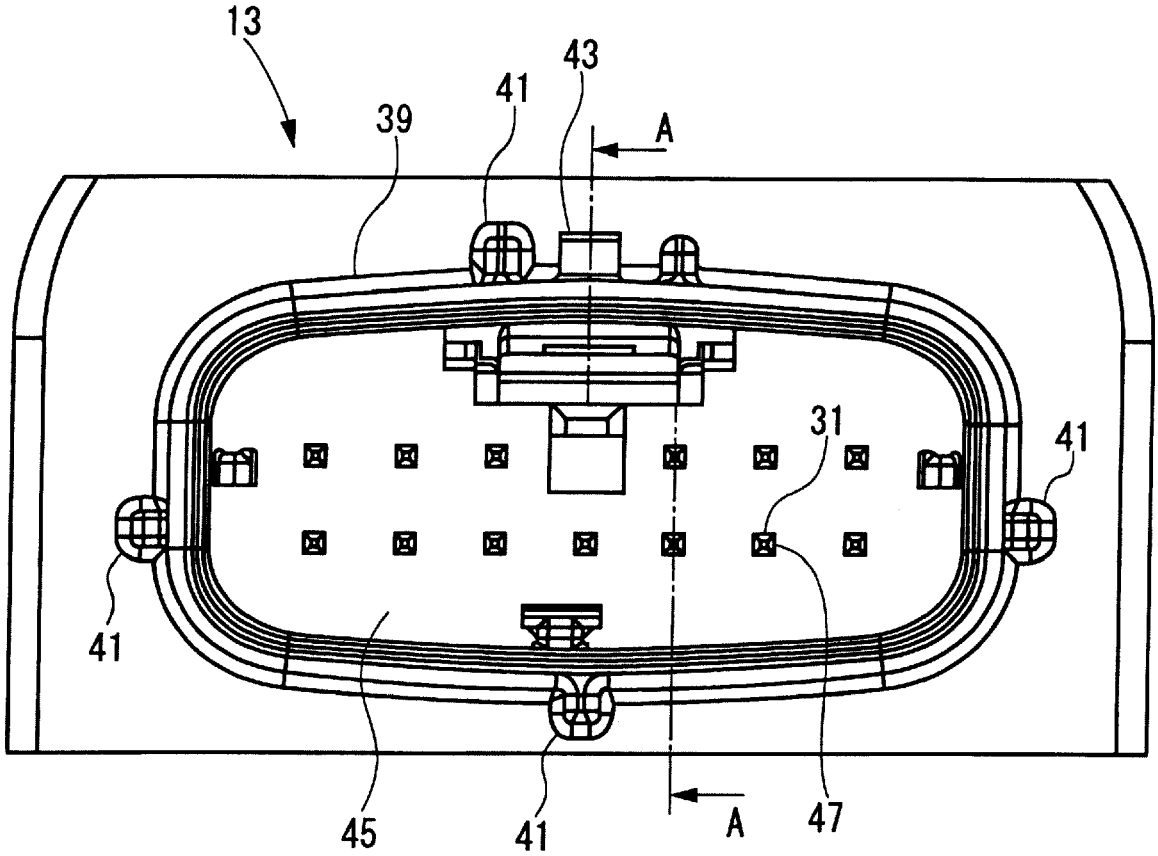
FIG. 3 is a front view of an outer housing.

FIG. 3 is a front view of the outer housing.

In an interior side of the hood part 39 of the outer housing 13, a terminal positioning regulating wall 45 is formed. The terminal positioning regulating wall 45 closes a front part of the mounting part 27. In the terminal positioning regulating wall 45, a plurality of contact part inserting holes 47 are arranged lengthwise and breadth-wise correspondingly to the plurality of terminals 17 attached to the inner housing 11. The contact part inserting holes 47 allow the electric contact parts 31 to pass through and be held.

Figure 4:
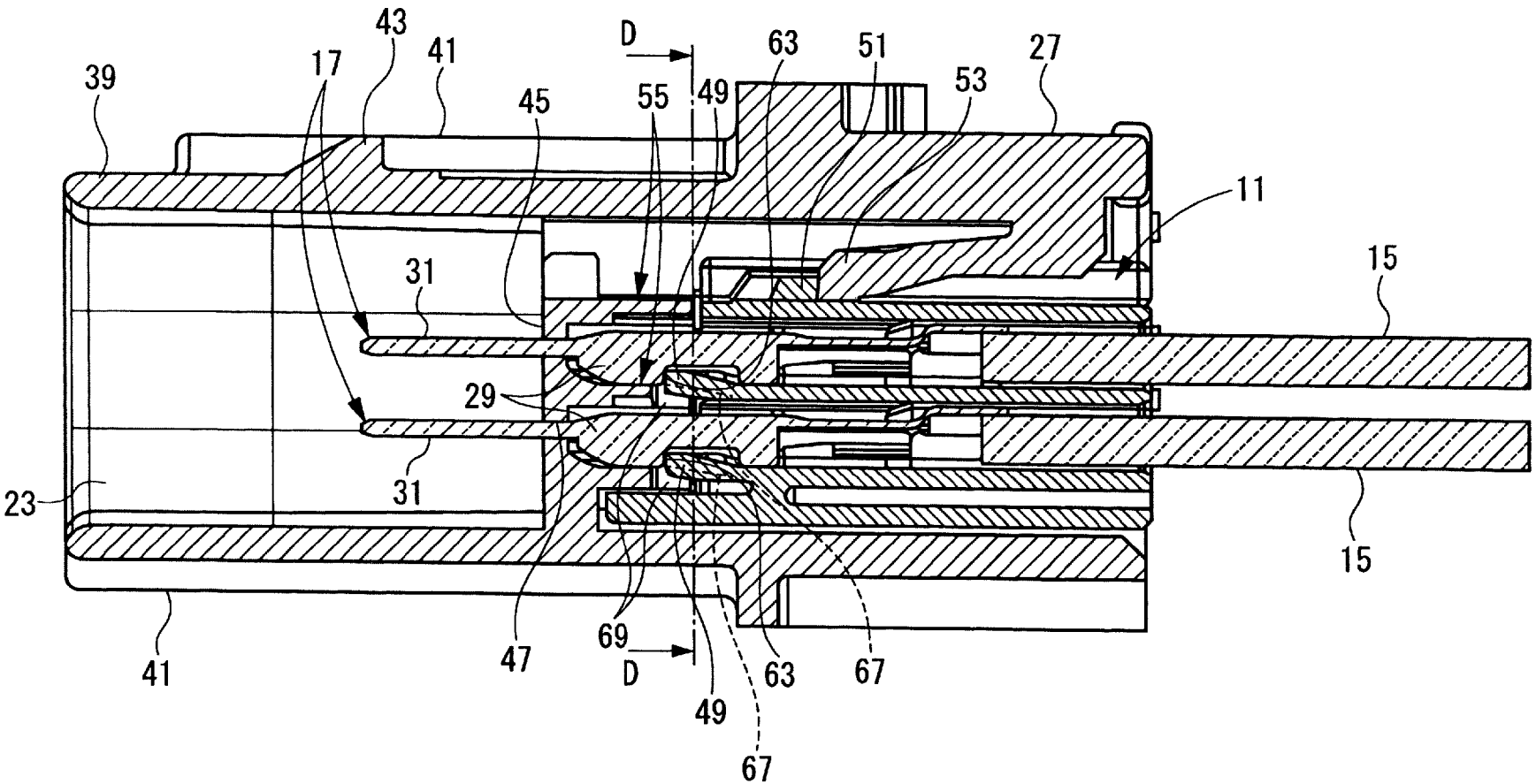
FIG. 4 is a sectional view taken along a line A-A of FIG. 3.

FIG. 4 is a sectional view taken along a line A-A of FIG. 3.

The inner housing 11 allows the terminal 17 inserted into an inner part to be engaged with a terminal engaging piece 49 and attached and the main body front part 29 to protrude from a front end. The outer housing 13 allows, in the normally engaged state, an engaging protrusion 51 of the inner housing 11 inserted into an inner part from a rear part to be engaged with a flexible engaging piece 53 so as not to detach the inner housing 11 from the outer housing 13. The electric contact part 31 protruding from the inner housing 11 under this state is inserted into the contact part inserting hole 47 of the terminal positioning regulating wall 45 provided in the outer housing 13.

Further, in a rear surface of the terminal positioning regulating wall 45, a front part positioning frame 55 protrudes correspondingly to the contact part inserting hole 47. The front part positioning frame 55 encloses the main body front part 29 to position the terminal.

Figure 5:
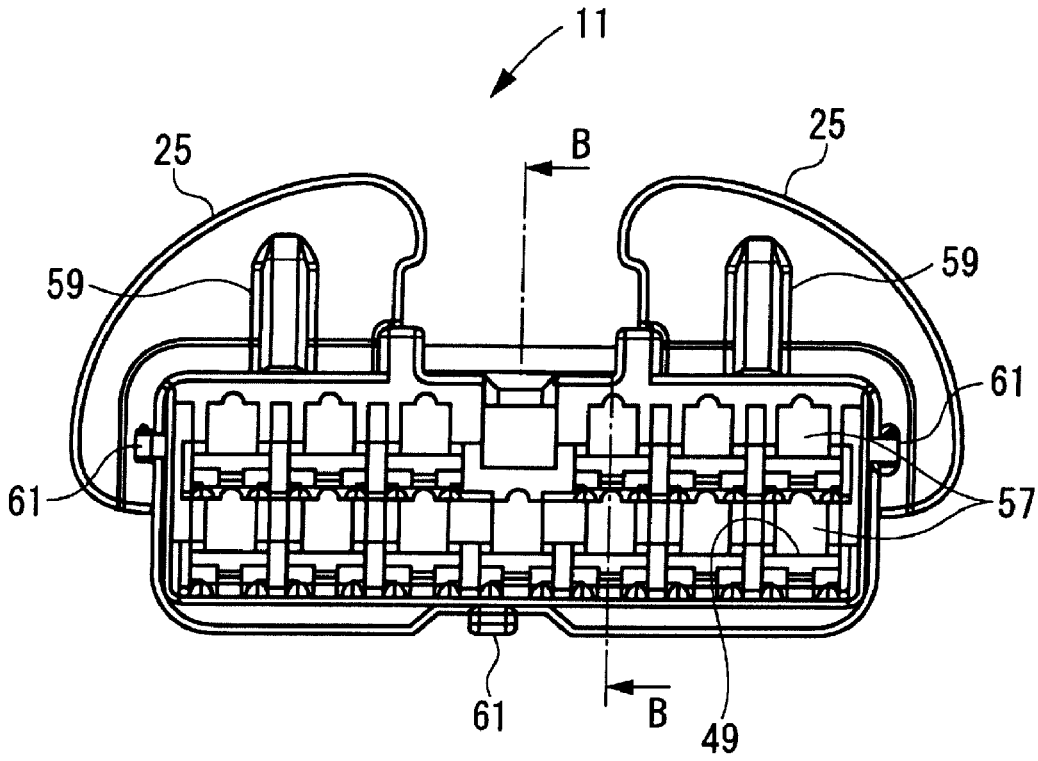
FIG. 5 is a front view of an inner housing.

FIG. 5 is a front view of the inner housing.

In the front end of the inner housing 11, a plurality of (13 in the present exemplary embodiment) terminal accommodating chambers 57 are opened. In a bottom part of each terminal accommodating chamber 57, the terminal engaging piece 49 is arranged. An end of the terminal engaging piece 49 can be elastically displaced upward and downward in the drawing. In the drawing, reference numeral 59 designates a reinforcing plate of the collar part 25 and 61 designates a guide protrusion.

Figure 6:
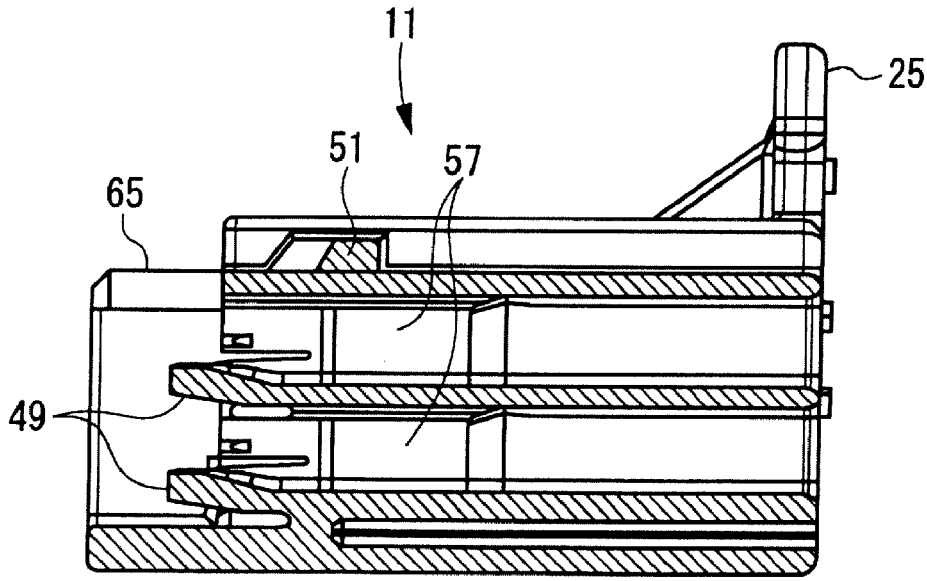
FIG. 6 is a sectional view taken along a line B-B of FIG. 5.

FIG. 6 is a sectional view taken along a line B-B of FIG. 5.

The terminal engaging piece 49 protrudes forward from the front end of the terminal accommodating chamber 57. That is, in the terminal 17 accommodated in the inner housing 11, the main body front part 29 located in a front part from an engaging part 63 (see FIG. 4) protrudes from the terminal accommodating chamber 57. The main body front part 29 protruding from the terminal accommodating chamber 57 is enclosed by a peripheral wall 65 provided in the outer periphery of the front end of the inner housing 11.

Figure 7:
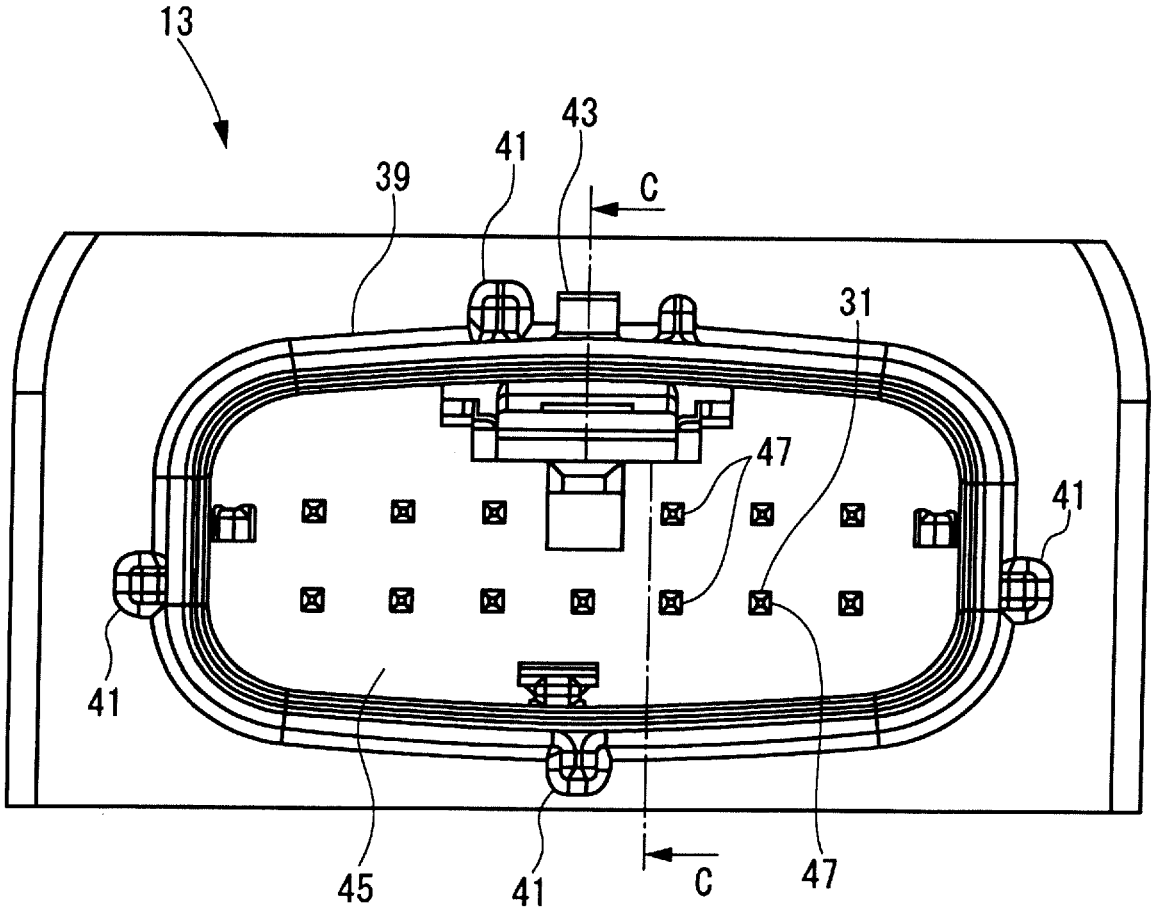
FIG. 7 is a front view of the outer housing showing other sectional line.

FIG. 7 is a front view of the outer housing showing other sectional line C-C.

The above-described FIG. 4 shows a A-A section of FIG. 3, namely, a section passing a center of an upper part of the outer housing 13 and the contact part inserting holes 47 shifting rightward from the center of the upper part of the outer housing 13. In this section, as shown in FIG. 4, the terminal 17 and the terminal engaging piece 49 form a section in a central part in a horizontal direction (a transverse direction in FIG. 3). On the other hand, in a section shown in FIG. 7, since the section is slightly shifted leftward from the contact part inserting holes 47, the main body front part 29 of the terminal 17 is located at a position deviating from the section, only the electric contact part 31 is shown and the terminal engaging piece 49 has its side part shown. The section is shown in FIG. 8.

Figure 8:
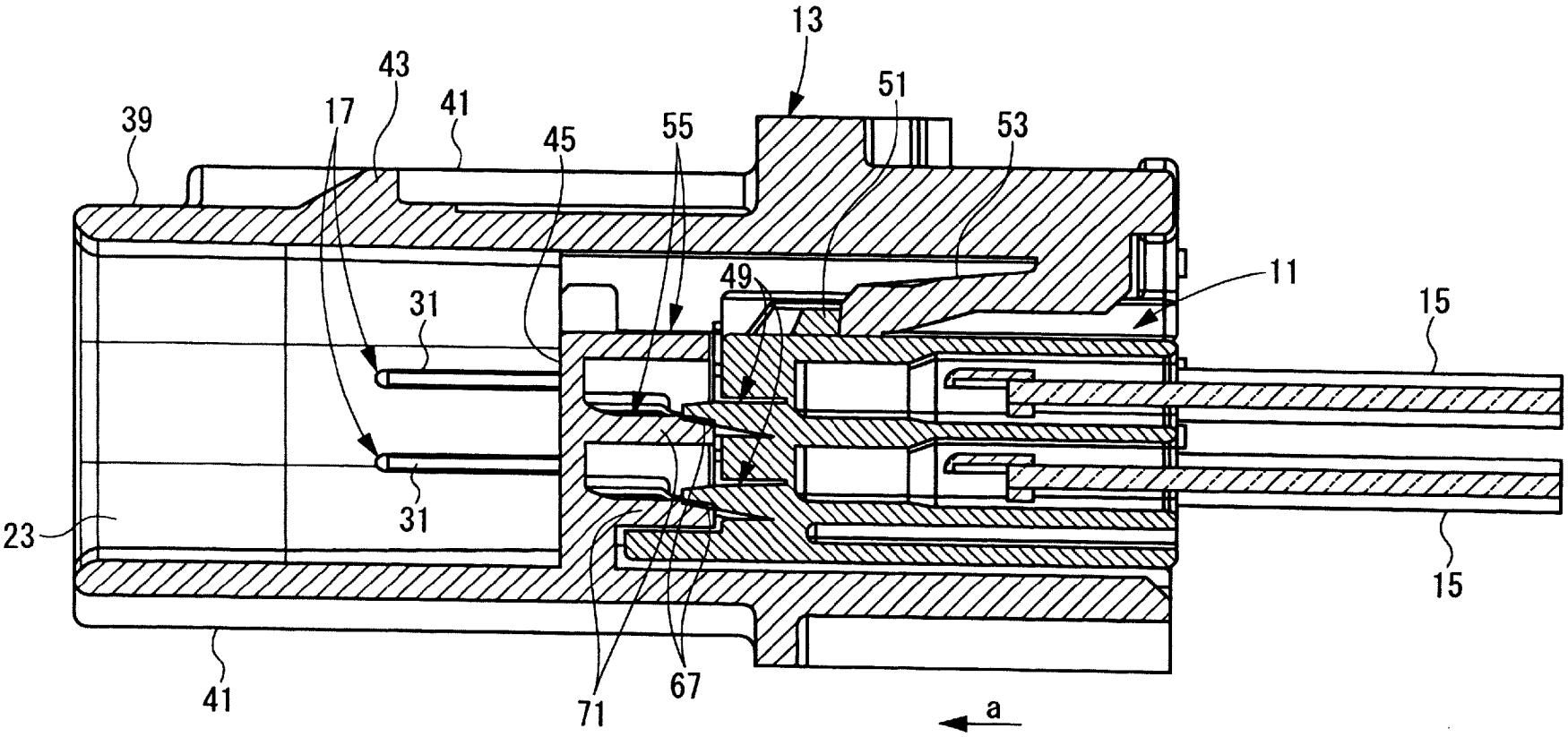
FIG. 8 is a sectional view taken along a line C-C in FIG. 7.

FIG. 8 is a sectional view taken along a line C-C in FIG. 7.

As shown in the sectional view, the side part of the terminal engaging piece 49 has an inclined surface 67 whose thickness is gradually decreased toward an inserting direction (a direction shown by an arrow mark a) of the inner housing. The inclined surface 67 is provided in both surfaces of the terminal engaging piece 49.

Figure 9:
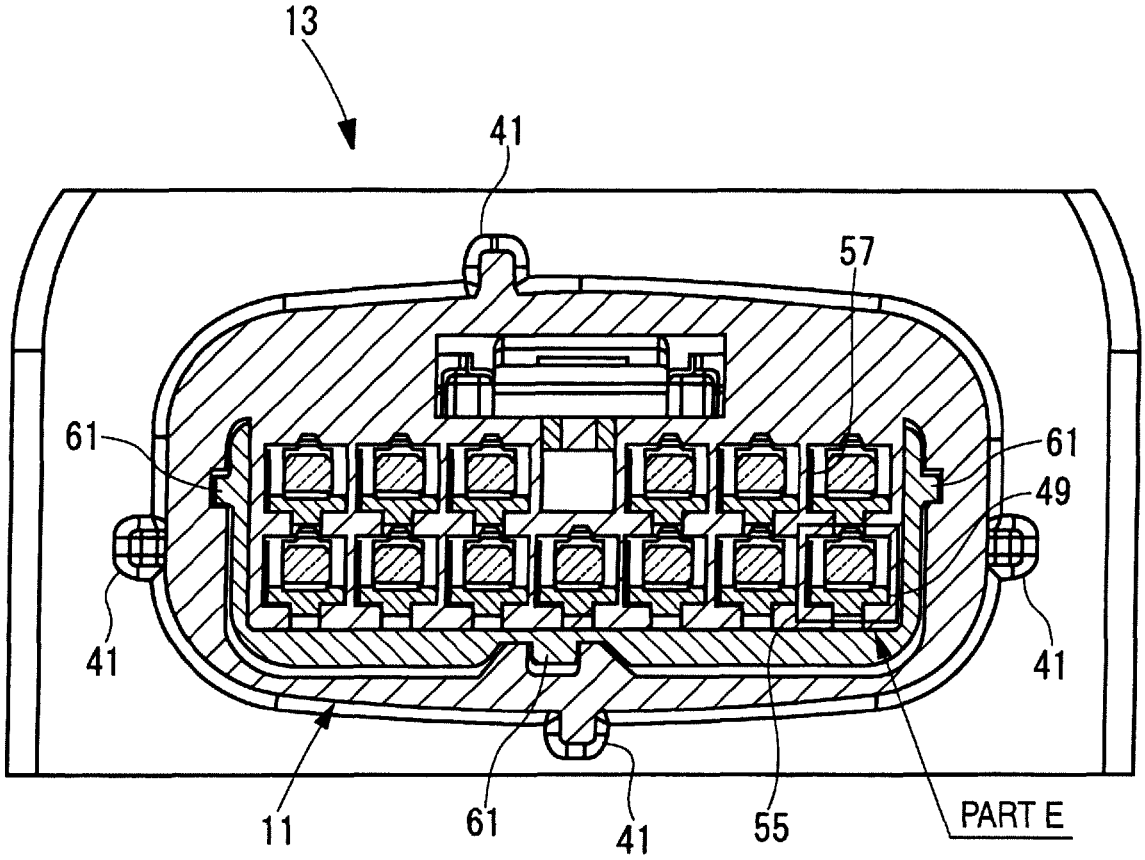
FIG. 9 is a sectional view taken along a line D-D of FIG. 4.

FIG. 9 is a sectional view taken along a line D-D of FIG. 4.

Under a state that the terminal 17 is accommodated in the terminal accommodating chamber 57, the engaging part 63 arranged in a lower part is engaged with the terminal engaging piece 49 of the inner housing 11. The terminal engaging piece 49 is arranged closely to the bottom part of the front part positioning frame 55 of the outer housing 13.

Figure 10:
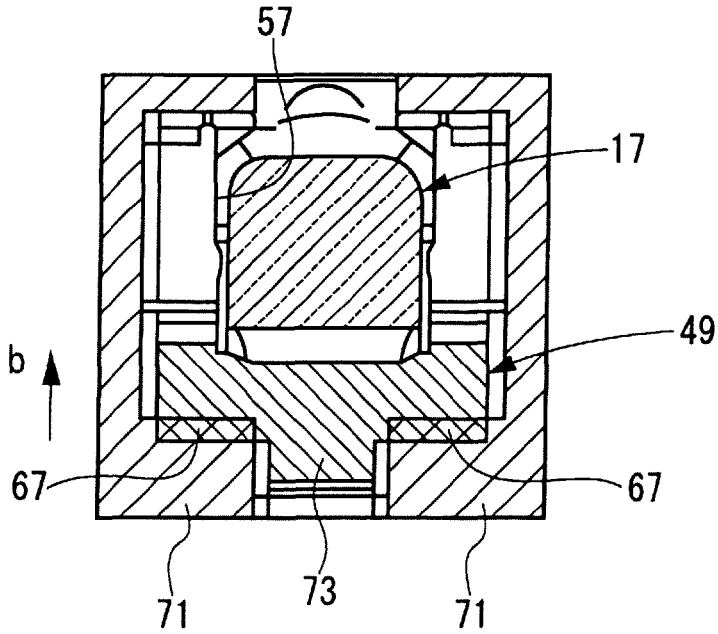
FIG. 10 is an enlarged view of a part E of FIG. 9.

FIG. 10 is an enlarged view of a part E of FIG. 9.

In the front part positioning frame 55 of the outer housing 13, engaging piece regulating bottom plates 71 and 71 are formed that are inserted into disengaging spaces 69 (see FIG. 4) of the terminal engaging piece 49. The engaging piece regulating bottom plate 71 regulates the displacement of the terminal engaging piece 49 toward a disengaging direction. Namely, when the inner housing 11 is attached to the outer housing 13, the engaging piece regulating bottom plate 71 provided in the outer housing 13 enters the disengaging space 69 of the inner housing 11 to regulate the displacement of the terminal engaging piece 49 toward the disengaging direction (in a downward direction in FIG. 10). As a result, the terminal 17 is double engaged.

The terminal engaging piece 49 comes into contact with the engaging piece regulating bottom plate 71 through the inclined surface 67 shown in FIG. 8. When the inner housing 11 is inserted into the outer housing 13, the inclined surface 67 of the terminal engaging piece 49 is gradually mounted on the engaging piece regulating bottom plate 71 as shown in FIG. 8. When the inclined surface 67 of the terminal engaging piece 49 is mounted on the engaging piece regulating bottom plate 71, the terminal engaging piece 49 is bent toward a direction separating from the engaging piece regulating bottom plate 71, that is, a direction (a direction shown by an arrow mark b in FIG. 10) in which the terminal engaging piece 49 is more strongly engaged with the terminal 17. Thus, the terminal 17 is more strongly fixed under the pressure of the terminal engaging piece 49.

Further, in the present exemplary embodiment, as shown in FIG. 10, one pair of spaced engaging piece regulating bottom plates 71 and 71 are inserted into both sides in the lower surface of the terminal engaging piece 49. Both the sides of the terminal engaging piece 49 abut on the one pair of engaging piece regulating bottom plates 71 and 71, so that the displacement of the terminal engaging piece 49 may be regulated in a horizontal direction where the displacement in a distorting direction is small and the reliability of a double engagement is enhanced. Further, since a part 73 of the terminal engaging piece 49 can enter the spaced part, the thickness of that part can be increased and the terminal engaging piece 49 of high strength can be formed.

Now, an operation of the divided connector 100 constructed as described above will be described below.

Figure 11:
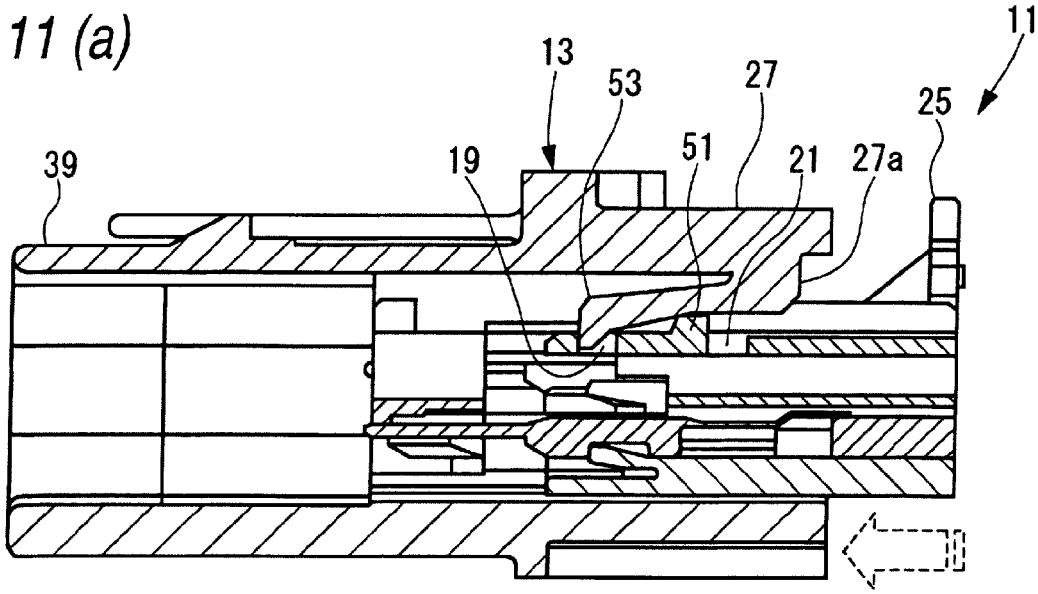
FIG. 11(*a*) is a sectional view of the inner housing in a temporarily engaged state, FIG. 11(*b*) is a sectional view of the inner housing in a normally engaged state and FIG. 11(*c*) is an enlarged view of a main part thereof.
Figure 11:
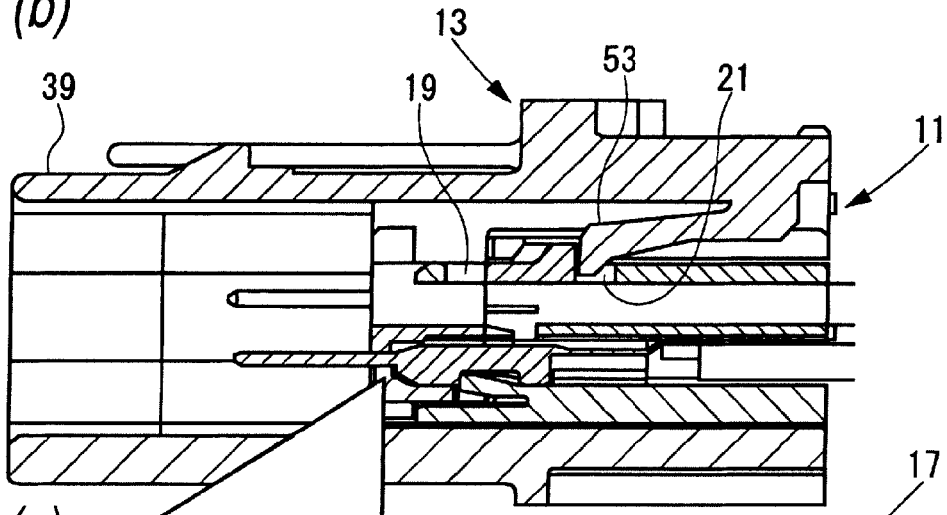
Figure 11:
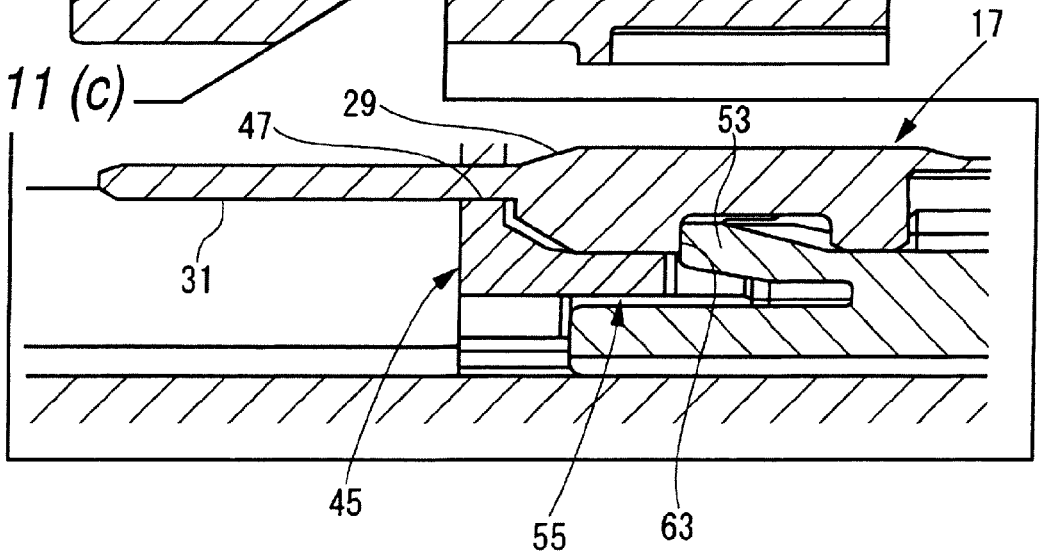

FIG. 11(*a*) is a sectional view of a temporarily engaged state of the inner housing, FIG. 11(*b*) is a sectional view of a normally engaged state of the inner housing and FIG. 11(*c*) is an enlarged view of a main part thereof.

In the divided connector 100, as shown in FIG. 11(*a*), under the temporarily engaged state that the inner housing 11 is inserted into the outer housing 13 and the flexible engaging piece 53 is engaged with the temporary engaging hole 19 of the inner housing 11, the terminal 17 is attached to the inner housing. The terminal 17 may be attached to the inner housing 11 before the inner housing 11 is temporarily engaged with the outer housing 13.

When the inner housing 11 to which the terminal 17 is attached is temporarily engaged with the outer housing 13, then, as shown in FIG. 11(*b*), the inner housing 11 is further pushed into the outer housing 13. When the inner housing 11 is pushed into a final position, as shown in FIG. 11(*c*), the electric contact part 31 is inserted into the contact part inserting hole 47 of the terminal positioning regulating wall 45 to its base end so that the deflection of the electric contact part 31 is regulated. At the same time, the main body front part 29 of the terminal 17 is fitted to the front part positioning frame 55 provided in the terminal positioning regulating wall 45. Thus, an entire part of the terminal 17 is directly positioned and held in the outer housing 13 with high strength.

In addition thereto, the engaging piece regulating bottom plates 71 and 71 shown in FIG. 8 enter the disengaging spaces 69 of the inner housing 11 to regulate the displacement of the terminal engaging piece 49 in the disengaging direction. Namely, the terminal 17 is double engaged under a state that the terminal engaging piece 49 engaged with the engaging part 63 is locked so as not to move toward the disengaging direction.

As described above, in the divided connector 100, when the inner housing 11 to which the terminal 17 is attached is inserted into the outer housing 13, the main body front part 29 of the terminal 17 protruding from the front end of the inner housing 11 is positioned in the front part positioning frame 55 provided in the outer housing 13. Thus, the front holder that has been hitherto used is not required and the high strength positional regulation of the terminal can be realized without generating a backlash by using the small number of parts.

Accordingly, since the divided connector 100 of the present exemplary embodiment includes the inner housing 11 that allows the main body front part 29 of the terminal 17 to protrude and the terminal to be attached, the outer housing 13 that allows the inner housing 11 to be attached and the front part positioning frame 55 protruding in the terminal positioning regulating wall 45 of the outer housing 13 to enclose and position the main body front part 29 of the terminal 17, the front holder that has been hitherto used is removed and the position of the terminal can be regulated by using the front part positioning frame 55 directly provided in the outer housing 13 and the small number of parts. As a result, the backlash can be eliminated and the positioning accuracy and the holding strength of the terminal 17 can be improved.

Further, since the inner housing 11 in the temporarily engaged state is pushed into the outer housing, the double engagement of the terminal 17 can be realized by a simple attaching operation. Further, the number of parts is reduced so that a metal mold operating time may be reduced.

What is claimed is:

1. A divided connector, comprising:

a terminal having an electric contact part protruding from a main body front part and an electric wire attached under pressure to a main body rear part;

an inner housing that allows the terminal inserted into an inner part to be engaged with a terminal engaging piece and attached and the main body front part to protrude from a front end;

an outer housing that allows the inner housing inserted into an inner part from a rear part to be engaged with a flexible engaging piece and attached;

a terminal positioning regulating wall provided in the outer housing and having a contact part inserting hole for inserting the electric contact part; and a front part positioning frame formed inside the outer housing and protruding in a rear surface of the terminal positioning regulating wall correspondingly to the contact part inserting hole to enclose and position the main body front part, wherein the outer housing, the terminal positioning regulating wall and the front part positioning frame are integrally formed as a single part.

2. The divided connector according to claim 1, wherein the front part positioning frame includes an engaging piece regulating bottom plate that is inserted into a disengaging space of the terminal engaging piece to regulate a displacement of the terminal engaging piece toward a disengaging direction.

3. The divided connector according to claim 2, wherein a pair of spaced engaging piece regulating bottom plates are inserted into both sides in a lower surface of the terminal engaging piece.

4. The divided connector according to claim 2, wherein the terminal engaging piece has an inclined surface whose thickness is gradually reduced toward an inserting direction of the inner housing and comes into contact with the engaging piece regulating bottom plate through the inclined surface.

5. The divided connector according to claim 1, wherein the outer housing, the terminal positioning regulating wall and the front part positioning frame are monolithically formed.

* * * * *